US008375578B2

(12) United States Patent
Kumakura

(10) Patent No.: US 8,375,578 B2
(45) Date of Patent: Feb. 19, 2013

(54) ELECTRIC WIRE PRESS FITTING METHOD

(75) Inventor: Hideto Kumakura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 546 days.

(21) Appl. No.: 12/627,105

(22) Filed: Nov. 30, 2009

(65) Prior Publication Data

US 2010/0154212 A1 Jun. 24, 2010

(30) Foreign Application Priority Data

Dec. 19, 2008 (JP) ..... 2008-323773

(51) Int. Cl.
*H01R 43/04* (2006.01)

(52) U.S. Cl. ..... 29/861; 29/511; 29/514; 29/862

(58) Field of Classification Search ..... 29/861, 29/511, 514, 517, 753, 862, 863, 865, 873; 72/412, 474; 174/84 C, 84 R, 87, 90, 94 R
See application file for complete search history.

(56) References Cited

U.S. PATENT DOCUMENTS 2,405,111 A * 8/1946 Carlson et al. ..... 439/868
2,729,695 A * 1/1956 Pierce ..... 174/84 C
2,802,257 A * 8/1957 Holtzapple ..... 29/862

FOREIGN PATENT DOCUMENTS

JP 2005-327690 A 11/2005

* cited by examiner

*Primary Examiner* — Thiem Phan
(74) *Attorney, Agent, or Firm* — Sughrue Mion, PLLC

(57) ABSTRACT

This invention provides with an electric wire press fitting method, in which an aluminum core wire of each of two aluminum wires are stranded to each other and inserted into a sleeve, and the aluminum core wire of each of the two aluminum wires are compressed and swaged along with the sleeve, wherein the sleeve includes a main body made of copper or a copper alloy; and the compression is performed on the aluminum core wire of each of the two aluminum wires at a compression ratio of 50 to 85% by the main body.

1 Claim, 6 Drawing Sheets

ELECTRIC WIRE PRESS FITTING METHOD

BACKGROUND OF THE INVENTION

1. Field of the Invention

The present invention relates to an electric wire press fitting method in which an aluminum core wire of each of two aluminum wires is stranded to each other and inserted into a sleeve, and the aluminum core wire of each of two aluminum wires are compressed and swaged along with the sleeve.

2. Field of the Invention

When aluminum wires are press fitted and swaged under the same conditions as copper wires, there are concerns that the strength of a terminal press fitting part is degraded, and stable conduction cannot be maintained between the aluminum wire and the terminal. Therefore, in Patent Document 1 described as follows, a terminal press fitting structure of press fitting a terminal into an aluminum wire formed by sheathing a number of stranded wires is proposed. In the terminal press fitting structure, a wire barrel of a closed barrel type terminal is press fitted into a conductor portion of the aluminum wire such that the upper portion of the wire barrel is crushed into a substantially W shape in an end face view.

Patent Document 1: JP-A-2005-327690

In the terminal press fitting structure, since press fitting was performed to crush the upper portion of the closed barrel to show the substantially W shape in the end face view, the press fitting operation was complex.

SUMMARY OF THE INVENTION

In order to solve the above-mentioned problem, an object of the invention is to provide an electric wire press fitting method.

This invention provides with an electric wire press fitting method, in which an aluminum core wire of each of the two aluminum wires are stranded to each other and inserted into a sleeve, and the aluminum core wire of each of the two aluminum wires are compressed and swaged along with the sleeve, wherein the sleeve includes a main body made of copper or a copper alloy; and the compression is performed on the aluminum core wire of each of two aluminum wires at a compression ratio of 50 to 85% by the main body.

According to the invention, a plurality of the aluminum core wires are compressed by the main body of the sleeve into which the aluminum cores are inserted, the main body being made of copper or a copper alloy, at a compression ratio of 50 to 85%, so that the press fitting operation can be performed in the same manner as copper wires, and it is possible to enhance the operability of the press fitting operation of the aluminum wires.

DESCRIPTION OF THE PREFERRED EMBODIMENTS

Hereinafter, an embodiment of the invention will be described with reference to the accompanying drawings.

Figure 1:
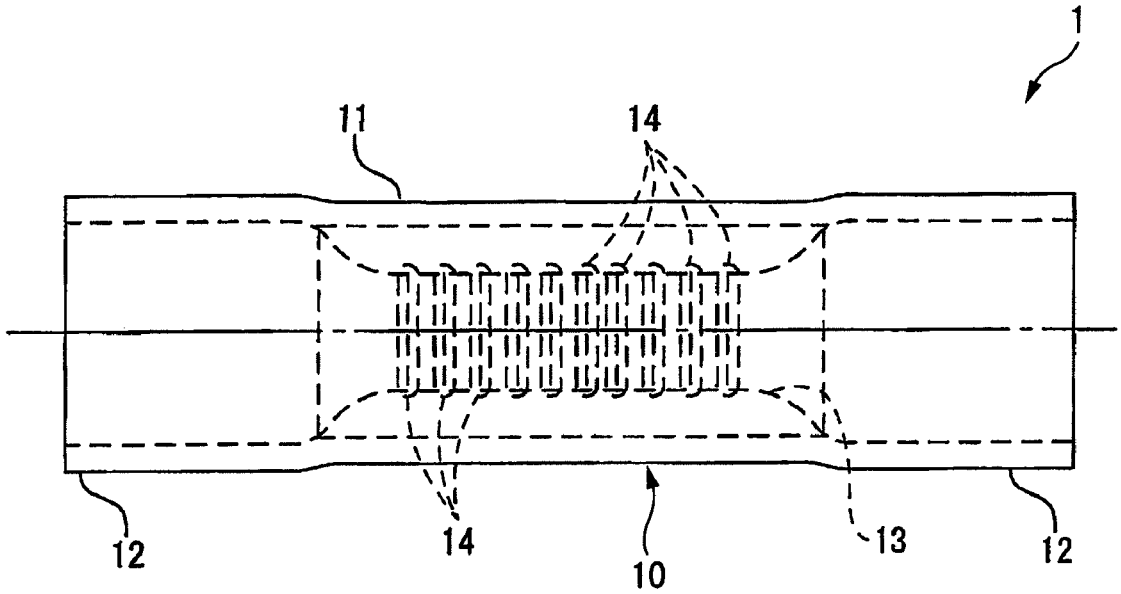
FIG. 1 is a side sectional view illustrating a sleeve used for an electric wire press fitting method according to an embodiment of the invention.

FIG. 1 is a side sectional view illustrating a sleeve 1 used for an electric wire press fitting method according to the embodiment.

The sleeve 1 illustrated in FIG. 1 is a repair sleeve used for the swaging of cooper wires, and configured by covering the outside of a main body 13 made of copper or an copper alloy with an insulator 10 which has a substantially cylindrical shape and is made of a resin. The main body 13 is fixed to the inner surface of a center portion 11 of which the diameter is reduced as compared with both end portions 12 of the insulator 10. On the inner surface of the main body 13, a plurality of serrations 14 extending to show an annular shape in the peripheral direction of the main body 13 are arranged along the axial direction. The serration 14 is used for ensuring a contact area with a conductor (in this embodiment, an aluminum core 22 of an aluminum wire 2) to be press fitted and break an oxide film. In a state where the sleeve 1 accommodates the aluminum core wire 22 (see FIGS. 2B, 2C) of the aluminum wire 2 that is inserted into the insulator 10 through one end portion 12 into the main body 13, the center portion 11 of the insulator 10 is pinched from the outside and compressed along with the aluminum core wire 22.

Figure 2A:
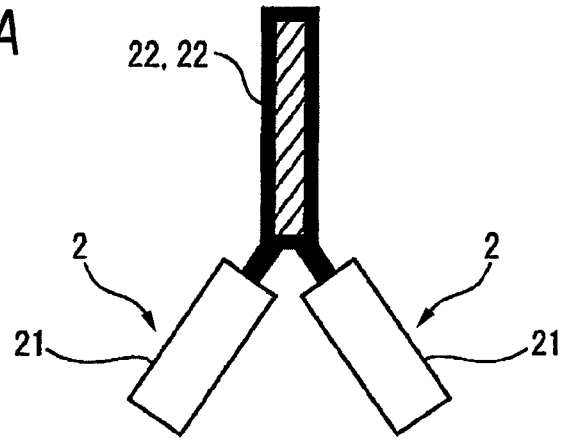
FIGS. 2A, 2B, and 2C are diagrams illustrating the press fitting method of aluminum wires.
Figure 2B:
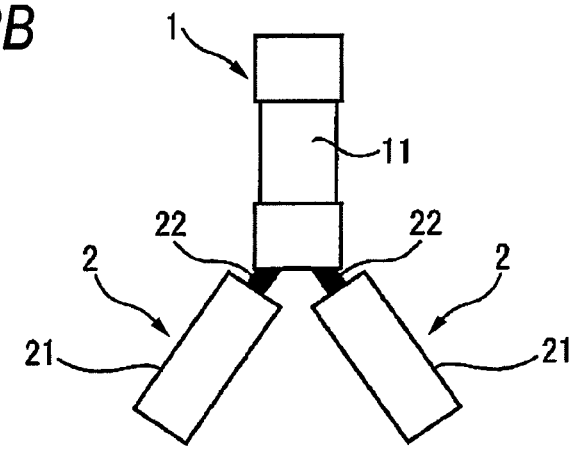
Figure 2C:
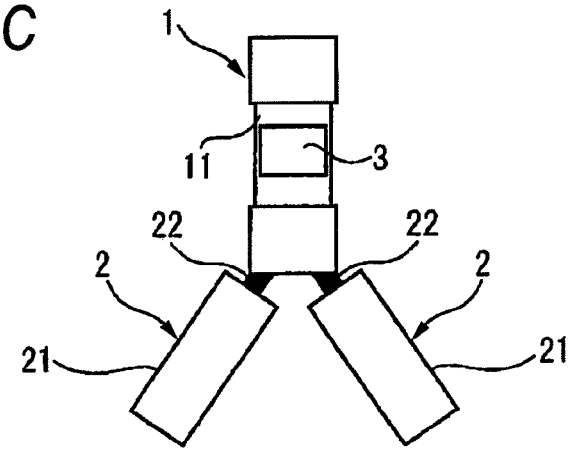
Figure 3A:
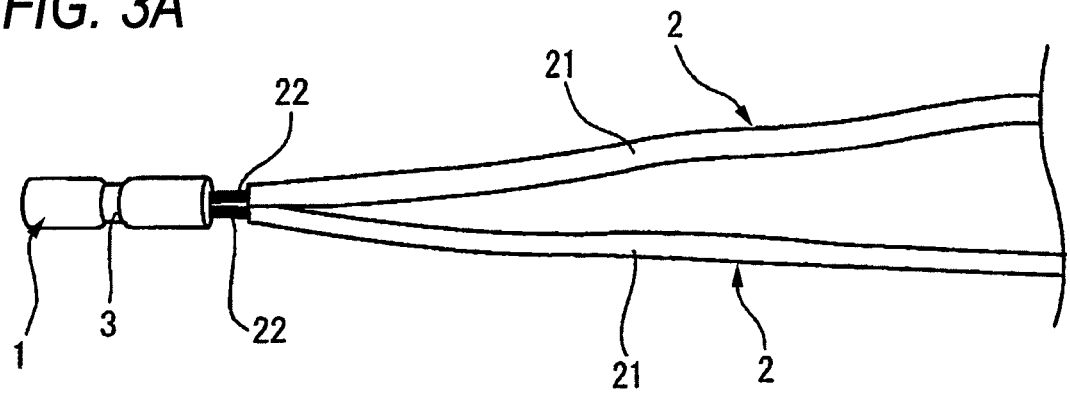
FIGS. 3A, and 3B are perspective views illustrating the aluminum wires press fitted using the sleeve.
Figure 3B:
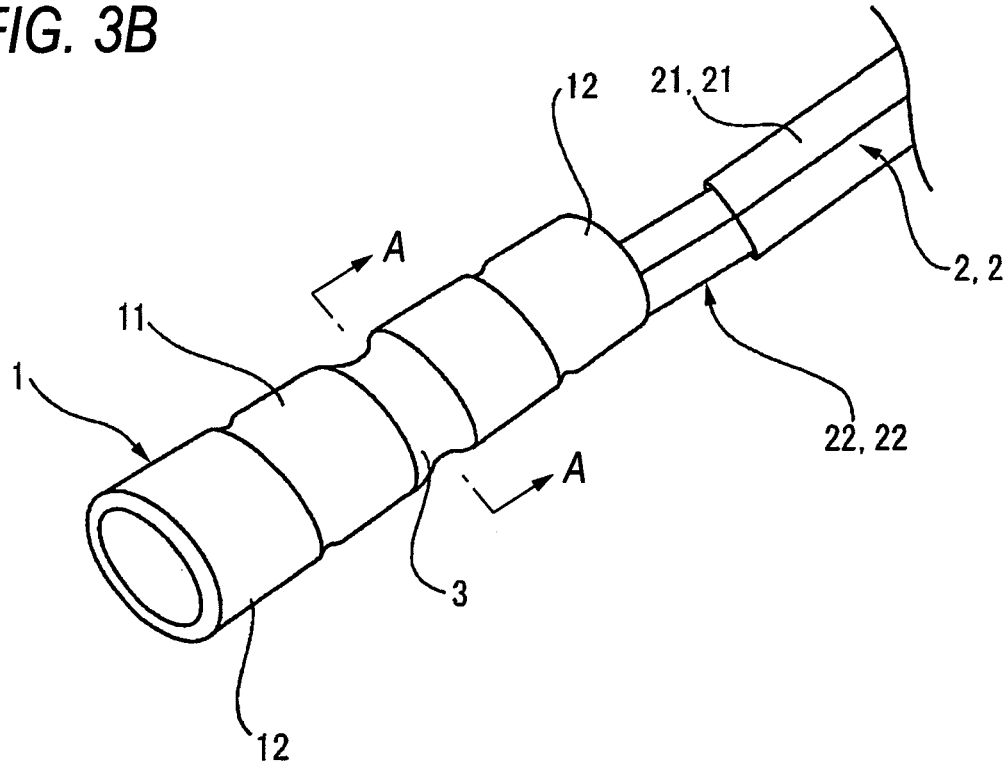

A press fitting method of the aluminum wires 2 using the sleeve 1 will be described with reference to FIGS. 2 and 3. FIGS. 2A, 2B, and 2C are diagrams illustrating the press fitting method of the aluminum wires 2. FIGS. 3A, 3B are perspective views illustrating the aluminum wires 2 press fitted using the sleeve 1. In the case where aluminum wires 2 are press fitted together using the sleeve 1, first, as illustrated in FIG. 2A, the aluminum cores 22 of the two aluminum wires 2 exposed by peeling claddings 21 from one end portion are stranded. Next, as illustrated in FIG. 2B, the aluminum core wires 22 that are stranded are covered by the sleeve 1 from the one side and as illustrated in FIG. 2C, the center portion 11 of the sleeve 1 is compressed and swaged. Accordingly, while being inserted into the sleeve 1 from the one side, the two stranded aluminum core wires 22 are press fitted at a swaging position 3 as illustrated in FIGS. 3A and 3B.

Figure 4A:
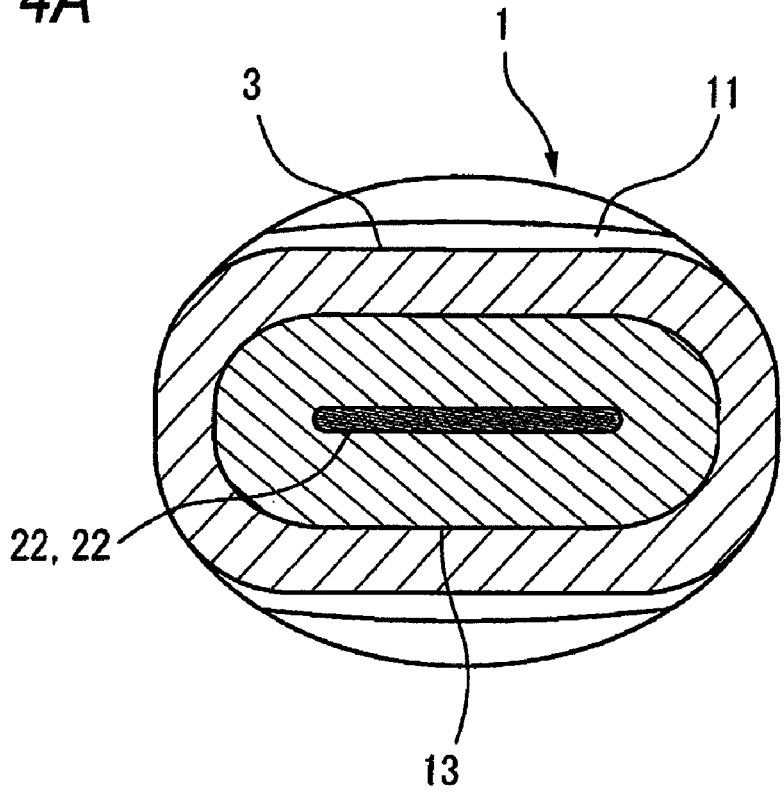
FIGS. 4A and 4B are diagrams illustrating aluminum core wires press fitted using the sleeve and is a cross-sectional view taken along the line A-A of FIG. 3B.
Figure 4B:
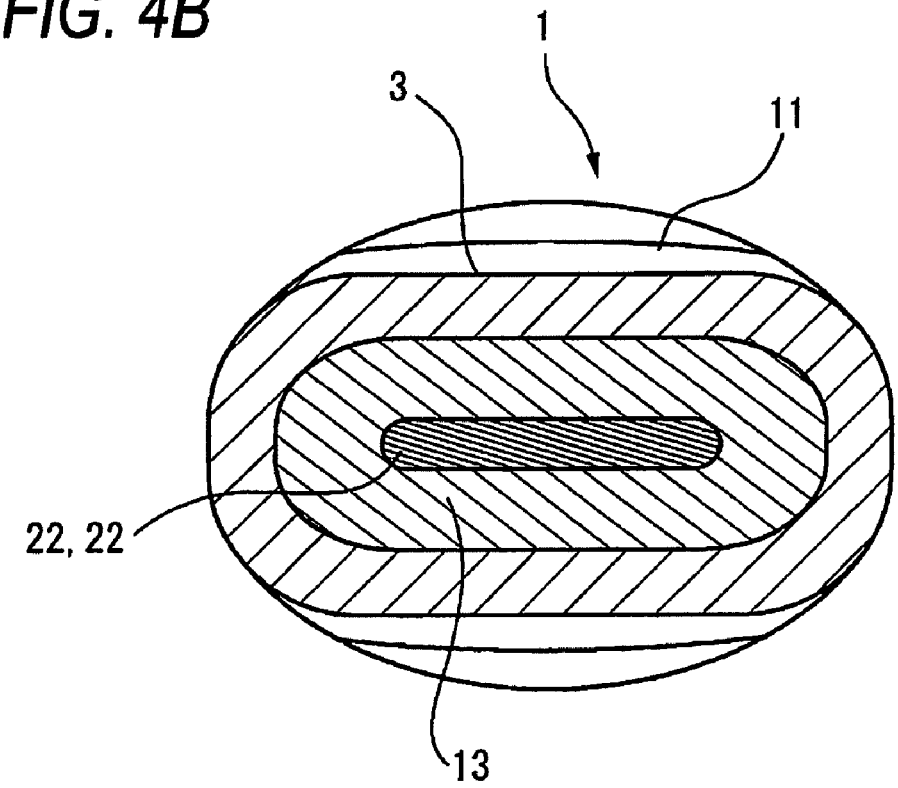

A press fitting structure of the aluminum core wires 22 configured as described above will be described with reference to FIGS. 4A and 4B. FIGS. 4A and 4B are diagrams illustrating the aluminum core wires 22 press fitted using the sleeve 1 and is a cross-sectional view taken along the line A-A of FIG. 3B. At the swaging position 3 of the sleeve 1, as illustrated in FIGS. 4A and 4B, the main body 13 is compressed along with the sleeve 1, and the two aluminum cores 22 accommodated into the main body 13 are also compressed. The aluminum core wires 22 are compressed at a compression ratio of 50 to 85%. In the example illustrated in FIG. 4A, the aluminum core wires 22 are compressed at a high compression ratio, and the cross-sectional area of the aluminum core wires 22 is small as compared with the case of FIG. 4(*b*). Here, the compression ratio is determined as "the cross-sectional area of the aluminum core wires 22 at the swaging position 3/the cross-sectional area of the aluminum core wires 22 before the press fitting"

Figure 5:
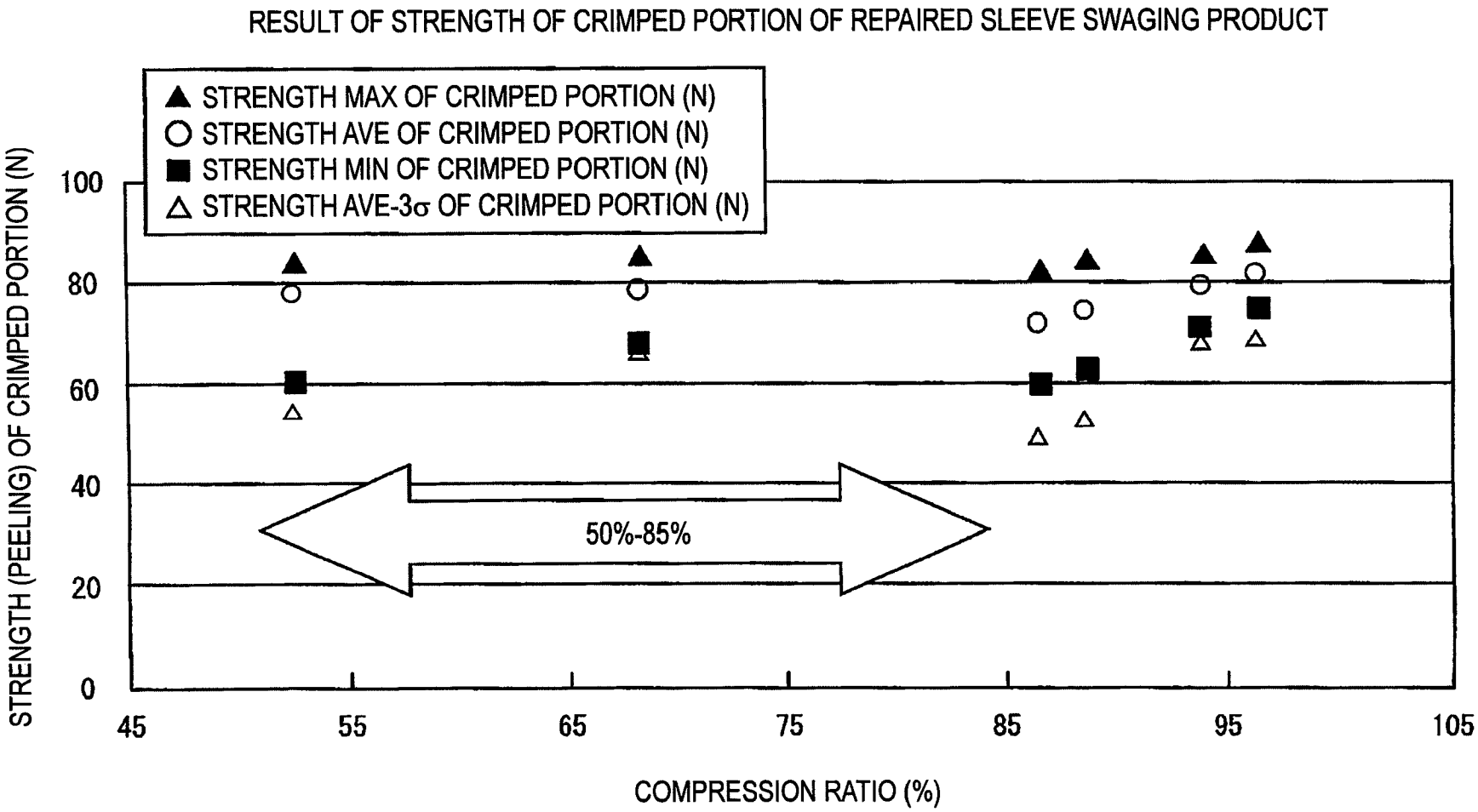
FIG. 5 is a graph showing differences in measured values obtained by measuring the peeling strength between the aluminum core wires press fitted using the sleeve.

A relationship between the peeling strength between the aluminum core wires 22 press fitted using the sleeve 1 and the compression ratio of the aluminum core wires 22 will be described. FIG. 5 is a graph showing differences in measured values obtained by measuring many times the peeling strength between the aluminum core wires 22 crimped using the sleeve 1.

The graph of FIG. 5 shows a maximum value (MAX), an average value (AVE), a minimum value (MIN), and an average value-3σ (AVE-3σ) where a standard deviation is σ, among the values measured in the case where press fitting is performed at a compression ratio of 50 to 95%. As illustrated in FIG. 5, in the case where the compression ratio is below 50% or above 85%, differences in the measured values of the peeling strength is large as compared with the case where the compression ratio is in the range of 50 to 85%.

For example, when the compression ratio becomes close to 50%, a difference of about 30N between the peeling strengths of the "average value-3σ" which is smallest and the "maximum value" which is largest is recognized. In addition, in the case where the compression ratio reaches 85 to 90%, in addition, a difference of about 30N between the peeling strengths of the "average value-3σ" which is smallest and the "maximum value" which is largest is recognized. With regard to this, when the compression ratio is close to 68%, the difference between the peeling strength of the "average value-3σ" which is smallest and the "maximum value" which is largest is reduced to about 20N.

Figure 6:
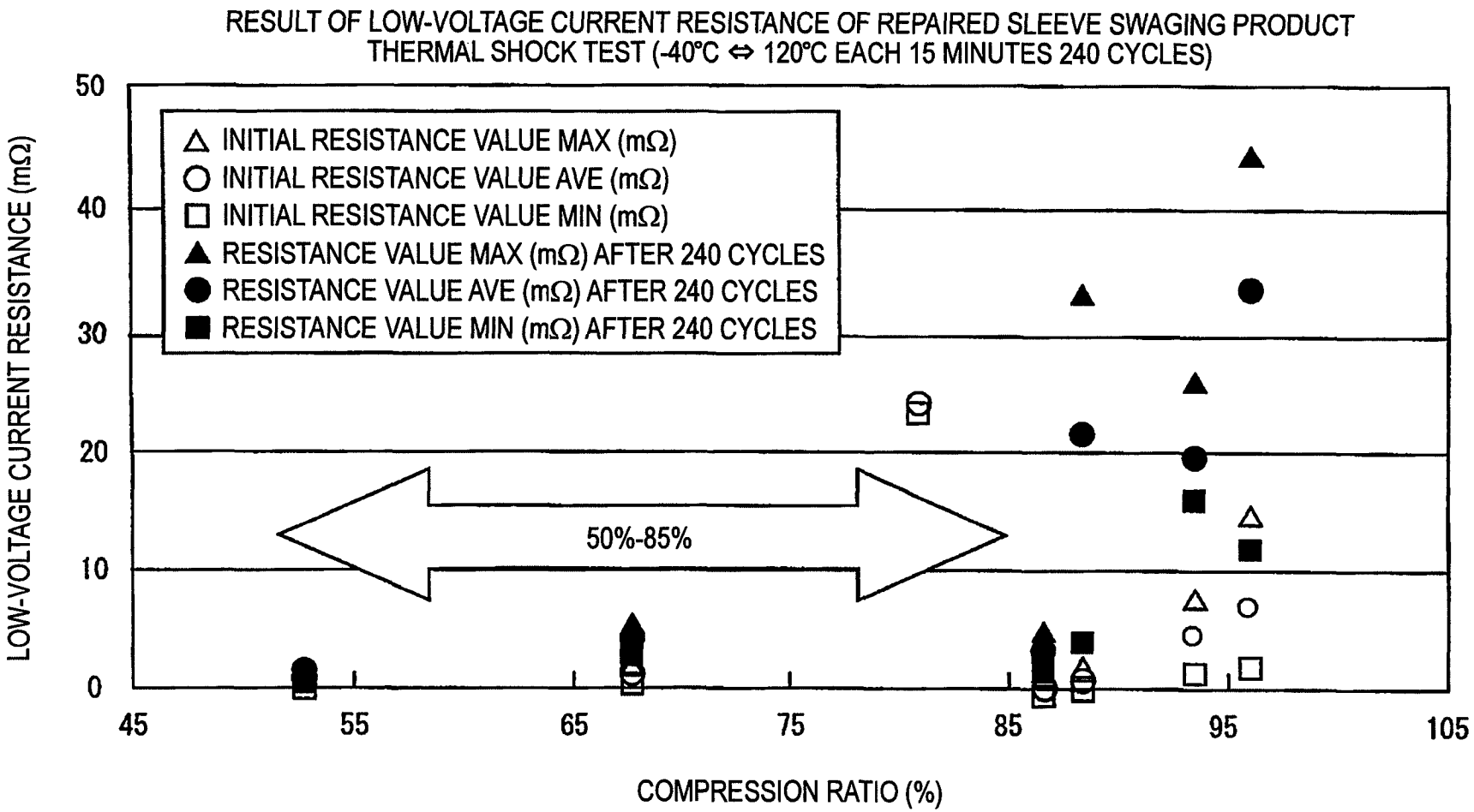
FIG. 6 is a graph showing the measurement result of a thermal shock test of a swaging product using the sleeve.

Next, a relationship between the strength of a press fitted portion of a sleeve swaging product repaired using the sleeve 1 and the compression ratio of the aluminum core wires 22 will be described. FIG. 6 is a graph showing the measurement result of a low-voltage current resistance in a thermal shock test of the repaired sleeve swaging product formed by press fitting the aluminum core wires 22 using the sleeve 1. In the thermal shock test, a cycle that is performed on the swaging product at a low temperature of −40° C. and a high temperature of 120° C. each of which takes 15 minutes is repeated by 240 cycles and the low-voltage current resistance is measured after each cycle. In the test, the current value is controlled such that the voltage at the time of opening a terminal which does not connect the repaired sleeve swaging product to a constant current source for supplying the measured current is 20 mV.

The graph of FIG. 6 shows the maximum value (MAX) (mΩ), the average value (AVE) (mΩ), and the minimum value (MIN) (mΩ) of the initial resistance measured in the case where the press fitting is performed at a compression ratio of 50 to 95%, and the maximum value (MAX) (mΩ), the average value (AVE) (mΩ), and the minimum value (MIN) (mΩ) of the resistance after 240 cycles. As illustrated in FIG. 6, in the case where the compression ratio is above 85%, the maximum values of the initial resistance and the resistance after 240 cycles are larger than those of the case where the compression ratio is below 85%.

For example, it is recognized that when the compression ratio is above 85% and approaches 90%, the maximum value (MAX) of the resistance after 240 cycles is above 30 (mΩ), however, when the compression ratio is below 85%, the maximum value (MAX) of the resistance after 240 cycles of the aluminum wire is below 5 (mΩ). As described above, the center portion 11 is compressed to achieve a compression ratio of 50 to 85%, so that the contact resistance of the aluminum wire 2 after swaging can be equal to or less than 5 mΩ in which is in a stable area. The compression ratio is selected from values of 50 to 85% so that the contact resistance of the aluminum wire 2 is in a more stable area of the contact resistance of 5 mΩ or less.

As described above, according to this embodiment, the center portion 11 is compressed to allow the compression ratio of the aluminum core wire 22 to be in the range of 50 to 85%, so that the contact resistance of the swaging product of the aluminum wire 2 can be allowed to have a small value, and sufficient fixing force of the aluminum core wire 22 can be obtained. Therefore, by performing the press fitting operation of the aluminum wire 2 in the same manner as the copper wire, it is possible to enhance the press fitting operability.

In addition, a terminal (the main body 13 in the sleeve 1) made of copper or copper metal (for example, galvanization) generally used for a connection with a plurality of copper wires is swaged to allow the compression ratio of the aluminum core 22 to be in the range of 50 to 85% so as to suppress the deterioration of electrical characteristics. Accordingly, for example, for the maintenance by a repairman or the like, instead of the aluminum terminal, a terminal made of copper or a copper alloy that has been spread in advance may be used.

In addition, in this embodiment, the case where the sleeve 1 includes the insulator 10 made of resin and the main body 13 made of copper or a copper alloy has been described. However, the material of the insulator 10 of the sleeve 1 is arbitrary, and other materials may also be employed. In addition, the method of fixing the main body 13 to the inner surface of the insulator 10 is also arbitrary.

What is claimed is:

1. An electric wire press fitting method for interconnecting a pair of aluminum wires using a sleeve including a main body portion made of copper or copper alloy, comprising the following:

stranding respective aluminum core wires associated with the pair of aluminum wires to each other;

inserting the stranded core wires into a sleeve; and compressing and swaging the stranded aluminum core wires along with the main body of the sleeve such that a compression ratio of the stranded core wires is in a range of 50 to 85%.

* * * * *